US009764207B2

(12) United States Patent
Fossum

(10) Patent No.: US 9,764,207 B2
(45) **Date of Patent: *Sep. 19, 2017**

(54) GOLF CLUB HEADS WITH SLIT FEATURES AND RELATED METHODS

(71) Applicant: Karsten Manufacturing Corporation, Phoenix, AZ (US)

(72) Inventor: Brandon L. Fossum, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/064,358

(22) Filed: Mar. 8, 2016

(65) Prior Publication Data

US 2016/0184668 A1 Jun. 30, 2016

Related U.S. Application Data

(63) Continuation of application No. 14/053,348, filed on Oct. 14, 2013, now Pat. No. 9,320,948.

(60) Provisional application No. 61/826,447, filed on May 22, 2013.

(51) Int. Cl.
*A63B 53/04* (2015.01)

(52) U.S. Cl.
CPC ..... *A63B 53/0466* (2013.01); *A63B 53/04* (2013.01); *A63B 2053/0408* (2013.01); *A63B 2053/0433* (2013.01); *A63B 2053/0437* (2013.01)

(58) Field of Classification Search
CPC ..... A63B 53/0466; A63B 53/04; A63B 53/08; A63B 2053/0408; A63B 2053/0437; A63B 2053/0433; A63B 60/00
See application file for complete search history.

(56) References Cited

U.S. PATENT DOCUMENTS

| | | | |
|---|---|---|---|
| 1,854,548 | A | 4/1932 | Hunt |
| 3,061,310 | A | 10/1962 | Giza |
| 3,556,532 | A | 1/1971 | Ballmer |
| D240,949 | S | 8/1976 | Jones |
| 4,398,965 | A | 8/1983 | Campau |
| 5,160,144 | A | 11/1992 | Maniatis |
| 5,346,219 | A | 9/1994 | Pehoski et al. |
| 5,437,456 | A | 8/1995 | Schmidt et al. |
| 5,533,728 | A | 7/1996 | Pehoski et al. |
| 6,086,485 | A | 7/2000 | Hamada et al. |
| 6,348,013 | B1 | 2/2002 | Kosmatka |
| 6,368,232 | B1 | 4/2002 | Hamada et al. |
| 6,783,465 | B2 | 8/2004 | Matsunaga |
| 7,211,006 | B2 | 5/2007 | Chang |
| 7,226,366 | B2 | 6/2007 | Galloway |
| 7,294,064 | B2 | 11/2007 | Tsurumaki et al. |
| 7,297,072 | B2 | 11/2007 | Meyer et al. |
| 7,318,782 | B2 | 1/2008 | Imamoto et al. |
| 7,344,452 | B2 | 3/2008 | Imamoto et al. |

(Continued)

FOREIGN PATENT DOCUMENTS

| | | | |
|---|---|---|---|
| EP | 1982751 | A1 | 10/2008 |
| JP | 06190088 | A | 7/1994 |

(Continued)

*Primary Examiner* — John E Simms, Jr.

(57) ABSTRACT

Golf club heads with slit features are described herein. Other embodiments and related methods are also disclosed herein.

20 Claims, 7 Drawing Sheets

(56) References Cited

U.S. PATENT DOCUMENTS

| | | | | |
|---|---|---|---|---|
| 7,347,795 | B2 | 3/2008 | Yamagishi et al. | |
| 7,438,649 | B2 | 10/2008 | Ezaki et al. | |
| 7,470,201 | B2 | 12/2008 | Nakahara et al. | |
| 7,500,924 | B2 | 3/2009 | Yokota | |
| 7,549,933 | B2 | 6/2009 | Kumamoto | |
| 7,582,024 | B2 | 9/2009 | Shear | |
| 7,632,196 | B2 | 12/2009 | Reed et al. | |
| 7,857,711 | B2 | 12/2010 | Shear | |
| 8,235,841 | B2 | 8/2012 | Stites et al. | |
| 8,235,844 | B2 | 8/2012 | Albertsen et al. | |
| 8,241,143 | B2 | 8/2012 | Albertsen et al. | |
| 8,241,144 | B2 | 8/2012 | Albertsen et al. | |
| 8,328,659 | B2 | 12/2012 | Shear | |
| 8,403,771 | B1 | 3/2013 | Rice et al. | |
| 8,435,134 | B2 | 5/2013 | Tang et al. | |
| 8,517,860 | B2 | 8/2013 | Albertsen et al. | |
| 8,821,312 | B2 | 9/2014 | Burnett et al. | |
| 8,827,831 | B2 | 9/2014 | Burnett et al. | |
| 8,834,289 | B2 | 9/2014 | De La Cruz et al. | |
| 8,858,360 | B2 | 10/2014 | Rice et al. | |
| 8,961,332 | B2 | 2/2015 | Galvan et al. | |
| 2004/0192463 | A1 | 9/2004 | Tsurumaki et al. | |
| 2007/0026961 | A1 | 2/2007 | Hou | |
| 2007/0049415 | A1* | 3/2007 | Shear | A63B 53/0466 473/349 |
| 2007/0117648 | A1* | 5/2007 | Yokota | A63B 53/0466 473/328 |
| 2010/0029408 | A1* | 2/2010 | Abe | A63B 53/0466 473/345 |
| 2011/0218053 | A1* | 9/2011 | Tang | A63B 53/04 473/349 |
| 2012/0142447 | A1 | 6/2012 | Boyd et al. | |
| 2012/0142452 | A1* | 6/2012 | Burnett | A63B 53/0466 473/345 |
| 2012/0270676 | A1* | 10/2012 | Burnett | A63B 53/04 473/346 |
| 2012/0277029 | A1 | 11/2012 | Albertsen et al. | |
| 2012/0277030 | A1 | 11/2012 | Albertsen et al. | |
| 2013/0102408 | A1 | 4/2013 | Shear | |
| 2013/0184100 | A1 | 7/2013 | Burnett et al. | |

FOREIGN PATENT DOCUMENTS

| | | | | |
|---|---|---|---|---|
| JP | 08173579 | A | 7/1996 | |
| JP | 2002052099 | A | 2/2002 | |
| JP | 2003-210621 | * | 7/2003 | A63B 53/04 |
| JP | 2004351173 | A | 12/2004 | |
| JP | 2005193069 | A | 7/2005 | |

* cited by examiner

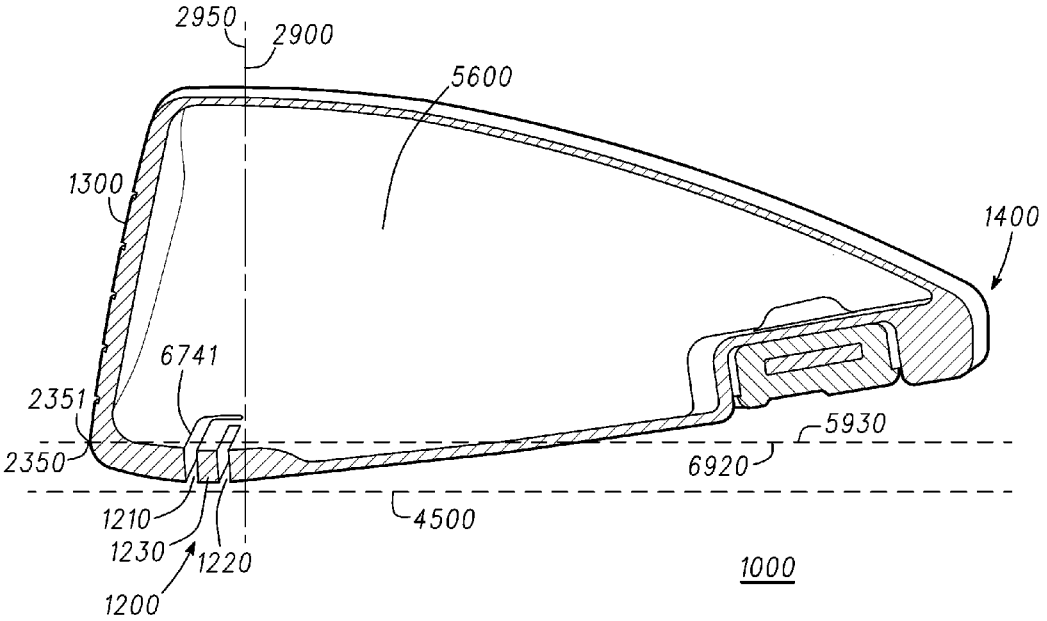
Fig. 5
Fig. 6
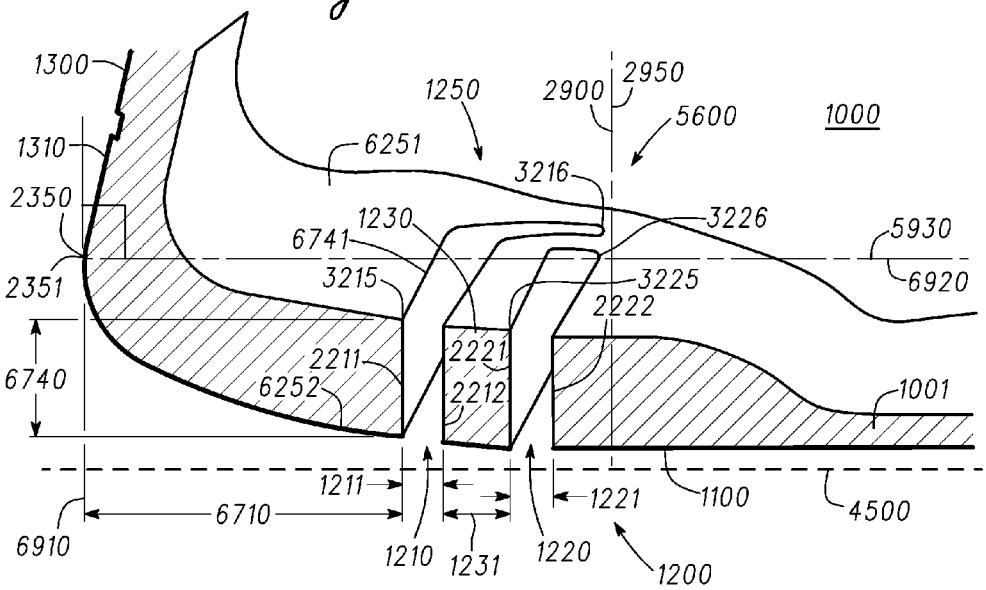

11000

GOLF CLUB HEADS WITH SLIT FEATURES AND RELATED METHODS

CLAIM OF PRIORITY

This is a continuation application of U.S. patent application Ser. No. 14/053,348, filed on Oct. 14, 2013, which claims the benefit of U.S. Provisional Patent Application No. 61/826,447, filed on May 22, 2013. The contents of the disclosures listed above are incorporated herein by reference.

TECHNICAL FIELD

The present disclosure generally relates to golf equipment and, more particularly, to golf club heads with slit features and related methods.

BACKGROUND

Modern wood-type golf club heads have been developed to accentuate or improve the performance thereof, such as by removing or rearranging mass to desired locations to adjust the location of the club head's center of gravity, and/or by introducing one or more elements, such as a slot, to adjust strikeface response for better golf launch characteristics. Such improvements, however, have to be balanced with the ability of the golf club head to withstand appropriate impact stresses without structural degradation or failures.

Considering the above, further developments with respect to reinforcing appropriate golf club features may enhance the performance of golf clubs while maintaining sufficient structural integrity thereof.

BRIEF DESCRIPTION OF THE DRAWINGS

The present disclosure will be better understood from a reading of the following detailed description of examples of embodiments, taken in conjunction with the accompanying figures in the drawings.

FIG. 5 illustrates a side cross-sectional view of the golf club head of FIG. 1.

FIG. 6 illustrates a detailed side cross-sectional view of the slit feature the golf club head of FIG. 1.

Figure 1:
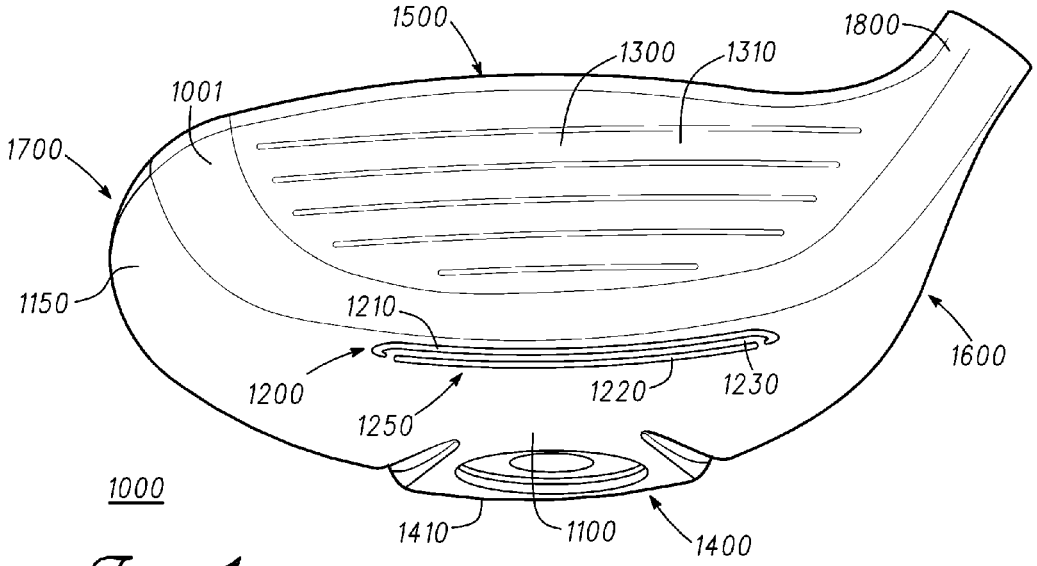
FIG. 1 illustrates a front-bottom perspective view of a golf club head having a slit feature at a sole thereof.

For simplicity and clarity of illustration, the drawing figures illustrate the general manner of construction, and descriptions and details of well-known features and techniques may be omitted to avoid unnecessarily obscuring the other relevant features or techniques. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

As defined herein, two or more elements are "integral" if they are comprised of the same piece of material. As defined herein, two or more elements are "non-integral" if each is comprised of a different piece of material. In addition, orthogonality of a line, with respect to a curved line or surface, is measured relative to a straight line or flat surface tangent to such curved line or surface.

DESCRIPTION

In one embodiment, a golf club head can comprise a body and a slit feature at a slit section of the body. The body can comprise a sole, a crown, a hosel, a body heel end, a body toe end, a body rear portion, and a strikewall. The slit section can comprise a portion of one of the sole or the crown. The hosel can define a shaft axis and a shaft axis plane that comprises the shaft axis and is orthogonal to a ground plane when the golf club head is at address over the ground plane. The slit feature can comprise a first slit, a second slit, and a first rib. The first slit can comprise a first forward slit edge and a first rearward slit edge. The second slit can comprise a second forward slit edge and a second rearward slit edge. The first rib can be defined between the first rearward slit edge of the first slit and the second forward slit edge of the second slit. At least one of the following can be located forward of the shaft axis plane: a first slit forwardmost point of the first slit, a first slit rearwardmost point of the first slit, a second slit forwardmost point of the second slit, or a second slit rearwardmost point of the second slit.

In one embodiment, a golf club head can comprise a body and a slit feature at a slit section of the body. The body can comprise a sole, a crown, a hosel, a body heel end, a body toe end, a body rear portion, and a strikewall. The slit section can comprise a portion of one of the sole or the crown. The hosel can define a shaft axis and a shaft axis plane that comprises the shaft axis and is orthogonal to a ground plane when the golf club head is at address over the ground plane. The slit feature can comprise a first slit, a second slit, and a first rib. The first slit can comprise a first forward slit edge, a first rearward slit edge, a first slit heelside section, and a first slit toeside section. The second slit can comprise a second forward slit edge, a second rearward slit edge, a second slit toewardmost point closest to the body toe end, a second slit heelwardmost point closest to the body heel end, and a second slit axis through the second slit heelwardmost point and the second slit toewardmost point. The first rib can be defined between the first rearward slit edge of the first slit and the second forward slit edge of the second slit. The second slit axis intersects the first slit heelside section and the first slit toeside section.

In one implementation, a method for providing a golf club head can comprise providing a body and providing a slit feature at a slit section of the body. The body can comprise a sole, a crown, a hosel, a body heel end, a body toe end, a body rear portion, and a strikewall. The slit section can comprise a portion of one of the sole or the crown. The hosel can define a shaft axis and a shaft axis plane that comprises the shaft axis and is orthogonal to a ground plane when the golf club head is at address over the ground plane. The slit feature can comprises a first slit, a second slit, and a first rib. The first slit can comprise a first forward slit edge and a first rearward slit edge. The second slit can comprise a second forward slit edge and a second rearward slit edge. The first rib can be defined between the first rearward slit edge of the first slit, an the second forward slit edge of the second slit. At least one of the following can be located forward of the shaft axis plane: a first slit forwardmost point of the first slit, a first slit rearwardmost point of the first slit, a second slit forwardmost point of the second slit, or a second slit rearwardmost point of the second slit.

Other examples and embodiments are further disclosed herein. Such examples and embodiments may be found in the figures, in the claims, and/or in the present description.

Figure 2:
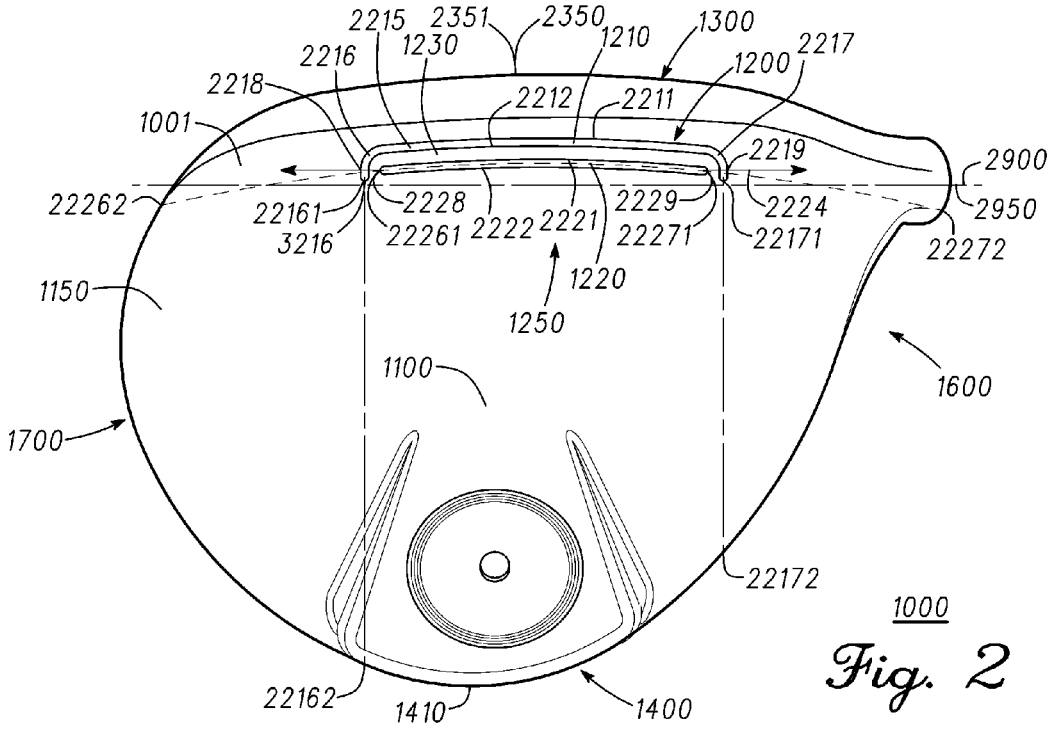
FIG. 2 illustrates a bottom view of the golf club head of FIG. 1.
Figure 3:
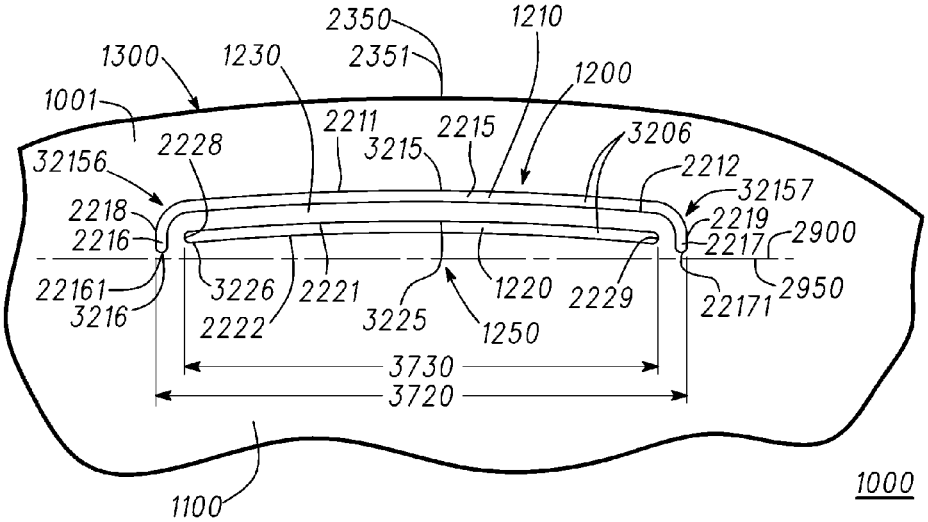
FIG. 3 illustrates a bottom view of a portion of the sole of the club head of FIG. 1, focused on the slit feature.
Figure 4:
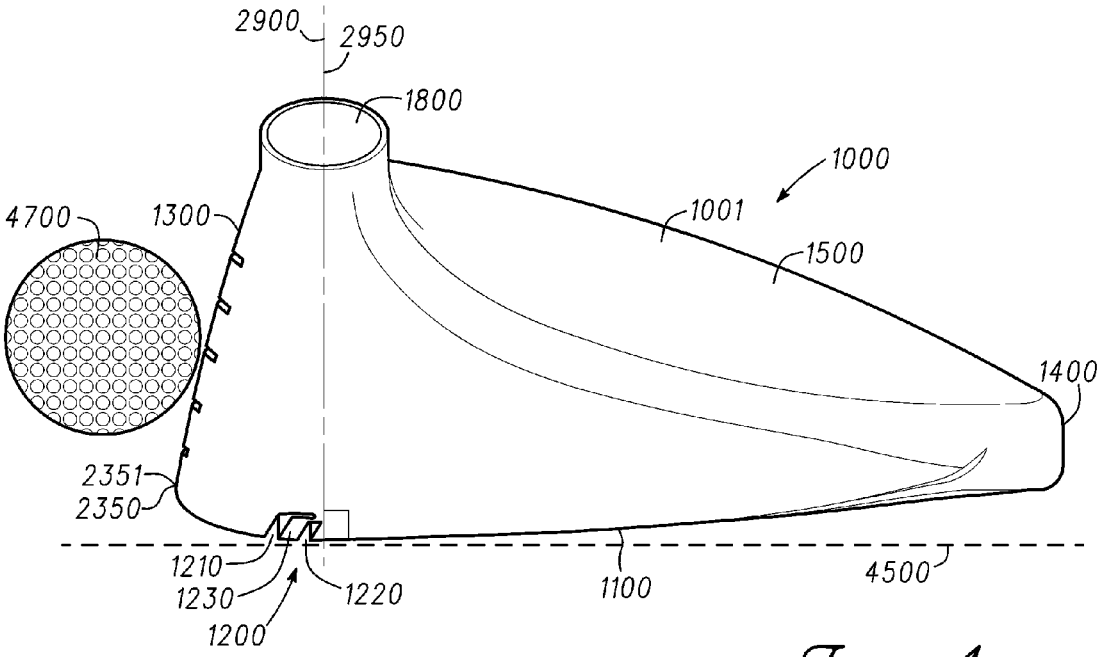
FIG. 4 illustrates a heel side view of the golf club head of FIG. 1 at address over a ground plane.

FIG. 1 illustrates a front-bottom perspective view of a golf club head 1000 having slit feature 1200 at sole 1100 thereof. FIG. 2 illustrates a bottom view of golf club head 1000. FIG. 3 illustrates a bottom view of a portion of sole 1100, focused on slit feature 1200. FIG. 4 illustrates a side view of golf club head 1000 at address over ground plane 4500. FIG. 5 illustrates a side cross-sectional view of golf club head 1000. FIG. 6 illustrates a detailed side cross-sectional view of slit feature 1200 at sole 1100 of golf club head 1000. FIGS. 4-6 do not show a gasket covering the slits of slit feature 1200.

Golf club head 1000 comprises body 1001 having sole 1100, crown 1500, skirt 1150, hosel 1800 defining shaft axis 2900 (FIG. 2), body heel end 1600, body toe end 1700, body rear portion 1400 with body rear end 1410, and strikewall 1300 comprising strikeface 1310. Slit feature 1200 comprises a slit set, having front slit 1210, back slit 1220, and rib 1230 therebetween, and is located at slit section 1250 of body 1001. As can be seen in FIG. 4, hosel 1800 also defines shaft axis plane 2950, which comprises shaft axis 2900 and is orthogonal to ground plane 4500 when golf club head 1000 is at address.

To prevent unwanted debris from entering cavity 5600 (FIG. 5), slits 1210 and 1220 are at least partially filled with gasket material 3206 (FIG. 3), which can comprise a relatively soft material (with low modulus of elasticity and rigidity) to cover covering the open slit. Gasket material 3206 can comprise a urethane material, a caulk material, and/or a silicon material in some examples. The apparatus, methods, and articles of manufacture are not limited in this regard.

Golf club head 1000 comprises a fairway-wood type head in the present embodiment, but can represent other kinds of golf club heads, such as a driver-type golf club head or a hybrid-type golf club head, in other embodiments. Slit section 1250, where slit feature 1200 is located, comprises a portion of sole 1100 in the present embodiment, but can be located elsewhere in other embodiments, such as at crown 1500 or at skirt 1150 of golf club head 1000. There can also be embodiments where a golf club head similar to golf club head 1000 can comprise a slit feature similar to slit feature 1200 at crown 1500 and/or at skirt 1150 of golf club head 1000. In the same or other embodiments, a golf club head similar to golf club head 1000 can comprise multiple slit features, such as a slit feature with a slit set at one of sole 1100, crown 1500, or skirt 1150 of golf club 1000, and another slit feature with a slit set at a different one of sole 1100, crown 1500, or skirt 1150 of golf club 1000.

Slit feature 1200 is designed to influence the dynamic impact bending that takes place during impact between golf club head 1000 and a golf ball like golf ball 4700 (FIG. 4). For example, slit feature 1200 can permit increased dynamic impact bending of strikeface 1310 to improve performance characteristics of golf club head 1000 by, for example, increasing ball speed, changing the initial launch angle and, and/or changing ball spin rate. By optimizing the shape and placement of slit feature 1200 at golf club head 1000, slit feature 1200 can also be used to influence forgiveness of mishits, for example, by complimenting the bulge and/or roll of strikeface 1310 and/or other inertial characteristics.

Slit feature 1200 can comprise one or more slits extending towards inner cavity 5600 (FIG. 5) of golf club head 1000, and can be located towards the transition between strikewall 1300 and sole 1100. In the present example, slit feature 1200 comprises front slit 1210 towards strikeface 1310, back slit 1220 towards rear portion 1400, and rib 1230 between front slit 1210 and back slit 1220. Each of front slit 1210 and back slit 1220 fully traverses slit section 1250 of body 1001, from slit section interior surface 6251 (FIG. 6) to slit section exterior surface 6252 (FIG. 6).

As shown in at least FIGS. 2, 3, and 6, front slit 1210 comprises front forward slit edge 2211 and front rearward slit edge 2212, while back slit 1220 comprises back forward slit edge 2221 and back rearward slit edge 2222. Rib 1230 is defined between rearward slit edge 2212 of front slit 1210 and forward slit edge 2221 of back slit 1220. Front slit 1210 comprises front forwardmost point 3215 and front rearwardmost point 3216, while back slit 1220 comprises back forwardmost point 3225 and back rearwardmost point 3226. There can be other examples, however, having a higher or lower number of slits and/or ribs.

In the present example, slit feature 1200 is located close to strikeface 1310 such as to permit impact forces to be more readily or directly received at slit feature 1200 to permit better deflection of strikeface 1310. Accordingly, slit feature 1200 is located at least partially forward of shaft axis plane 2950. In the present example, as seen in FIGS. 2, 3, 4, and 6, slit feature 1200 is located fully forward of shaft axis 2900, where front slit 1210 and back slit 1220 are entirely forward of shaft axis 2900.

There can be other examples, however, where slit feature 1200 need not be fully forward of shaft axis plane 2950 (FIG. 4). In such examples, at least a portion of front forward slit edge 2211 of front slit 1210, and/or at least a portion of back forward slit edge 2221 of back slit 1220, can be located forward of shaft axis plane 2950 (FIG. 4) even if a portion of front rearward slit edge 2212 of front slit 1210, and/or a portion of back rearward slit edge 2222 of back slit 1220, remains behind shaft axis plane 2950.

For instance, one embodiment can comprise at least front forwardmost point 3215 of front slit 1210 located forward of shaft axis plane 2950. In the same or other embodiments, at least front rearwardmost point 3215 of front slit 1210 can be located forward of shaft axis plane 2950. In the same or other embodiments, at least back forwardmost point 3225 of back slit 1220 can be located forward of shaft axis plane 2950. In the same or other embodiments, at least back rearwardmost point 3226 of back slit 1220 can be located forward of shaft axis plane 2950.

Several characteristics of slit feature 1200 can be designed or constrained to beneficially affect the performance of golf club head 1000. For instance, as seen in FIG. 6, slit feature offset 6710 can be constrained to limit the offset distance of slit feature 1200 relative to strikewall 1300, thereby placing slit feature 1200 close to strikeface 1310 such as to permit impact forces to be more readily or directly received at slit feature 1200 to permit better or increased deflection of strikeface 1310 at impact. In the present example, slit feature offset 6710 comprises a minimum distance from vertical lead plane 6910 to front forward slit edge 2211, where vertical lead plane 6910 is tangent to lead edge 2350 of strikewall 1300 and parallel to shaft axis plane 2950. Slit feature offset 6710 is approximately 8.9 mm (0.35 inch) in the present example, but can be approximately 2.5 mm (0.1 inch) to approximately 15.2 mm (0.6 inch) in the same or other examples.

Another characteristic of slit feature 1200 is front slit length 3720 of front slit 1210, which is measured as seen in FIG. 3 from front slit toewardmost point 2218 closest to body toe end 1700 (FIG. 1), to front slit heelwardmost point 2219 closest to body heel end 1600 (FIG. 1). Increasing the length of front slit length 3720 permits increasing the deflection of strikeface 1310 at impact for improved ball launch performance. Front slit length 3720 is approximately 57.2 mm (2.25 inches) in the present example, but can be approximately 25.4 mm (1 inch) to approximately 76.2 mm (3 inches) in the same or other examples.

Similarly, rear slit length 3730 of back slit 1220 is measured, as seen in FIG. 3, from back slit toewardmost point 2228 closest to body toe end 1700 (FIG. 1), to back slit heelwardmost point 2229 closest to body heel end 1600 (FIG. 1). Rear slit length 3730 can be approximately 75% to approximately 90% of front slit length 3720. There can be examples, however, with a rear slit length of approximately 0% to approximately 100% of front slit length 3720. There can be embodiments where rear slit feature 1200 can comprise front slit 1210 without back slit 1220. There also can be embodiments where back slit 1220 can be longer than front slit 1210. In these embodiments, for example, back forward slit edge 2221 can be located rearward of front slit rearwardmost point 3216.

A further characteristic of slit feature 1200 is slit height 6740 measured, as seen in FIG. 6, at forward slit edge 2211 from slit section interior surface 6251 to slit section exterior surface 6252, where slit section interior surface 6251 faces interior cavity 5600 of body 1001, and where slit section exterior surface 6252 faces an exterior of body 1001. An increase in slit height 6740 will tend to decrease the impact deflection of strikeface 1310, and should therefore be constrained to limit such effects on impact deflection. In the present example, slit height 6740 is approximately 3.2 mm (0.125 inch), but can be approximately 0.8 mm (0.03 inch) to approximately 12.7 mm (0.5 inch) in the same or other examples.

In the present embodiment, lead edge 2350 comprises strikewall forwardmost point 2351 of strikewall 1300. As seen in FIG. 6, horizontal lead axis 6920 comprises strikewall forwardmost point 2351 and is orthogonal to shaft axis plane 2950, but does not intersect slit feature 1200. Instead, top end 6741 of slit feature 1200 is configured to lie below horizontal lead axis 6920. Furthermore, golf club head 100 also includes horizontal lead plane 5930 as seen in FIG. 5, where horizontal lead plane 5930 comprises strikewall forwardmost point 2351, comprises horizontal lead axis 6920, is orthogonal to shaft axis plane 2950, and is parallel to ground plane 4500 when golf club head 1000 is at address over ground plane 4500. Top end 6741 of slit feature 1200 thus remains at or below horizontal lead plane 5930 along an entirety of front slit length 3720 (FIG. 3) in the present embodiment. Considering such dimensional characteristics of slit feature 1200 relative to lead edge 2350, as described above, top end 6741 of slit feature 1200 is thus configured to remain low such as to limit its protrusion relative to slit section 1250 of body 1001. Such characteristics can be beneficial, for example, to restrict any potential increase in the height of the center of gravity of golf club head 1000, and/or to restrict the size of slit height 6740 (FIG. 6) and thereby permit increased deflection of strikeface 1310 as described above.

In the present embodiment, at least front slit 1210 is curved or otherwise bends at opposite heel and toe ends thereof, where such curvature or bending can permit front slit 1210 to be narrowed but still withstand or dissipate impact stresses without compromising its structural integrity as a result of the additional impact absorption area at its heel and toe ends and/or as a result of the resulting angle at which such impact stresses are received at its heel and toe ends. For instance, as seen in FIG. 2, front slit 1210 comprises front slit toeside section 2216, front slit heelside section 2217, and front slit midsection 2215 therebetween, where front slit toeside section 2216 and front slit heelside section 2217 are curved or bent relative to front slit midsection 2215. In the present embodiment, the curvature rate for front slit toeside section 2216, and the curvature rate for front slit heelside section 2217, are each different than the curvature rate of front slit midsection 2215, and the curvature rate for front slit toeside section 2216 and/or for front slit heelside section 2217 can be greater than the curvature rate of front slit midsection 2215. In one implementation, the curvature rate of front slit midsection 2215 can comprise a radius of curvature greater than 25.4 mm (1 inch), such as approximately 76.2 mm (3 inches) to infinity. In the same or other implementations, the curvature rate for at least a portion of front slit toeside section 2216 and/or of front slit heelside section 2217 can be less than 25.4 mm (1 inch), such as approximately 5.1 mm (0.2 inch) to approximately 22.9 mm (0.9 inch).

Although in the present example the curvature rate of front slit midsection 2215 is similar to the curvature rate of lead edge 2350, such that front slit midsection 2215 and lead edge 2350 are substantially parallel to each other, there can be other examples where the curvature rate of front slit midsection 2215 can differ from that of lead edge 2350, and/or can be substantially zero to yield a substantially straight front slit midsection 2215.

As can also be seen in FIG. 2, back slit 1220 comprises back slit toewardmost point 2228 and back slit heelwardmost point 2229 as described above, and also comprises back slit axis 2224 through back slit toewardmost point 2228 and back slit heelwardmost point 2229. In the present embodiment, due to the curving or bending of front slit 1210 described above, back slit axis 2224 intersects front slit toeside section 2216 and front slit heelside section 2217 of front slit 1210. Furthermore, as seen in FIG. 3, again due to the curving or bending of front slit 1210 described above, front slit rearwardmost point 3216 can be located rearward of back slit forwardmost point 3225 and/or rearward of back slit rearwardmost point 3226.

In addition, as seen in FIG. 2, front slit 1210 comprises front slit heel endpoint 22171, which points towards body heel edgepoint 22172 of body 1001, and front slit toe endpoint 22161, which points towards body toe edgepoint 22162 of body 1001. Back slit 1220 comprises back slit heel endpoint 22271, which points towards body heel edgepoint 22272 of body 1001, and back slit toe endpoint 22261, which points towards body toe edgepoint 22262 of body 1001. In the present example, due to the curving or bending of front slit 1210 described above, body heel edgepoint 22172 (pointed by front slit heel endpoint 22171) is rearward of body heel edgepoint 22272 (pointed by back slit heel endpoint 22271). In addition, body toe edgepoint 22162 (pointed by front slit toe endpoint 22161) is rearward of body toe edgepoint 22262 (pointed by back slit toe endpoint 22261). Back slit toe endpoint 22261 can coincide with back slit toewardmost point 2228, and back slit heel endpoint 22271 can coincide with back slit heelwardmost point 2229, but there can be other embodiments without such coincidence.

Such curving or bending described above can yield a corresponding slit bend for slit 1210. For instance, as seen in FIG. 3, front slit 1210 comprises heelside slit bend 32157 between front slit midsection 2215 and front slit heelside section 2217, and toeside slit bend 32156 between front slit midsection 2215 and front slit toeside section 2216. There can be examples where one or more of toeside slit bend 32156 and/or heelside slit bend 32157 can comprise a bend of approximately 15 degrees to approximately 180 degrees. For instance, where toeside slit bend 32156 is greater than 90 degrees, front slit toeside section 2216 can extend behind of back rearward slit edge 2222 of rear slit 1220. In the present example, each of heelside slit bend 32157 and toeside slit bend 32156 is approximately 90 degrees, but there can be other embodiments where the magnitude of heelside slit bend 32157 and toeside slit bend 32156 can be different from each other. Rib 1230 can also comprise a heelside rib bend similar to or corresponding to heelside slit bend 32157, and/or a toeside rib bend similar to or corresponding to toeside slit bend 32156.

In some implementations, the width of the slits of slit feature 1200 can be constrained to a narrow dimension, which can be beneficial for controlling the distance amount that strikeface 1310 deflects at impact, to permit rib 1230 to better receive or absorb impact stresses, and/or permit rib 1230 to spring forward to aid in the rebound of strikeface 1310 for increased ball speed. As seen in FIG. 6, slit feature 1200 is configured in the present example such that front slit 1210 comprises slit width 1211, back slit 1220 comprises slit width 1221, and rib 1230 comprises rib width 1231. Slit widths 1211 and 1221 are up to approximately 2.54 mm (0.1 inch), such as approximately 1 mm (0.04 inch) in the present example. Slit widths 1211 and/or 1221 can be constrained in the same or other implementations to be less than approximately 6.35 mm (0.25 inch). In the same or other embodiments, one or more of slit width 1211 or 1221 can be narrow enough to permit strikeface 1310 to bend at impact such that front forward slit edge 2211 of front slit 1210 can contact and/or push rib 1230 backwards, where rib 1230 can thus absorb impact stresses and/or spring forward to aid in the rebound of strikeface 1310 for increased ball speed. In the present example, rib width 1231 is approximately 2 mm (0.08 inch), but there can be other examples where rib width 1231 can be approximately 1 mm (0.04 inch) to approximately 12.7 mm (0.5 inch).

In the present example, each slit of slit feature 1200 comprises dimensions that are substantially regular. For example, the width, height, and cross-sectional area of slit 1210 and of slit 1220 remain substantially constant along their respective lengths. There can be other examples where only a subset of the slits of slit feature 1200 comprises a width, depth, and/or cross-sectional area that is substantially regular, however. For instance, in some implementations, the width and/or height of one or more of slits 1210 or 1220 can increase and/or decrease at or towards its center or the center of strikewall 1300.

Figure 7:
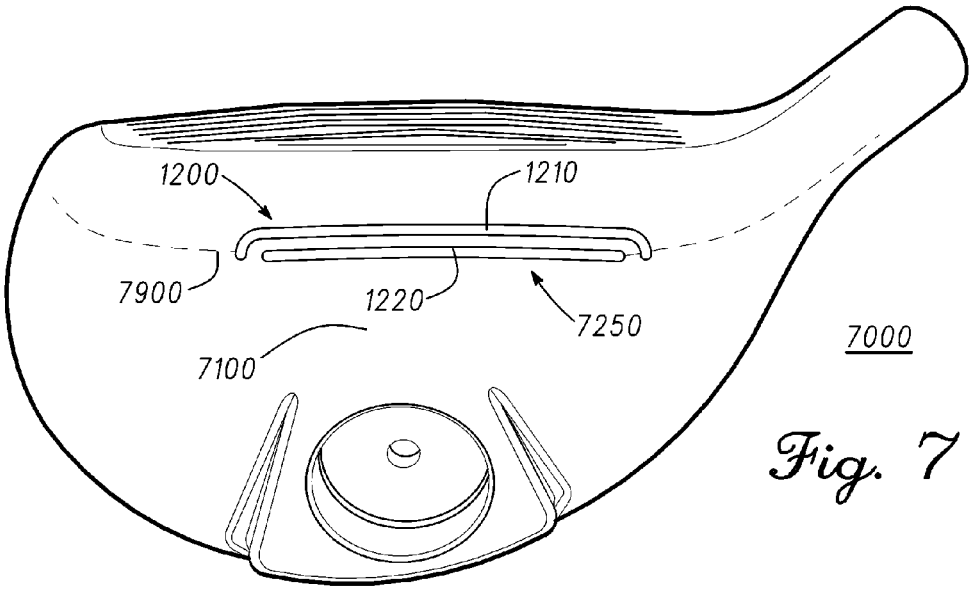
FIG. 7 illustrates a front-bottom perspective view of another golf club head that also has a slit feature at a sole.
Figure 8:
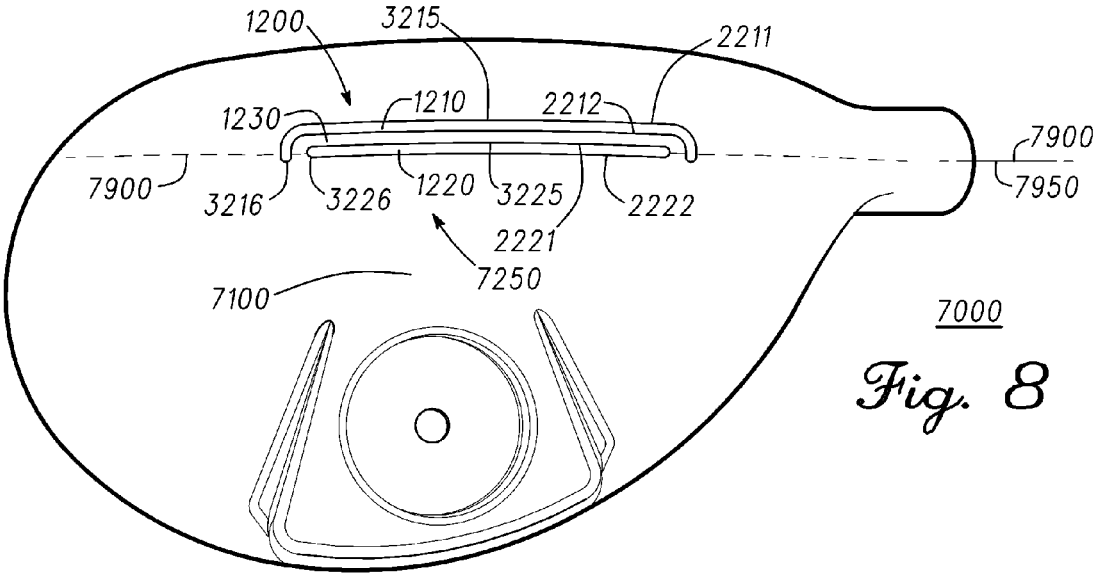
FIG. 8 illustrates a bottom view of the golf club head of FIG. 7.
Figure 9:
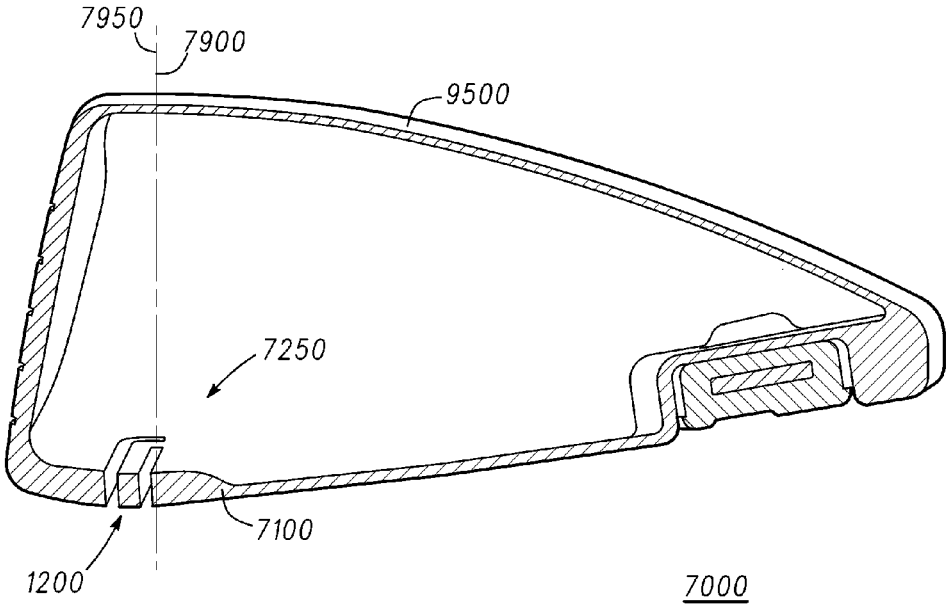
FIG. 9 illustrates a side cross-sectional view of the golf club head of FIG. 7.
Figure 10:
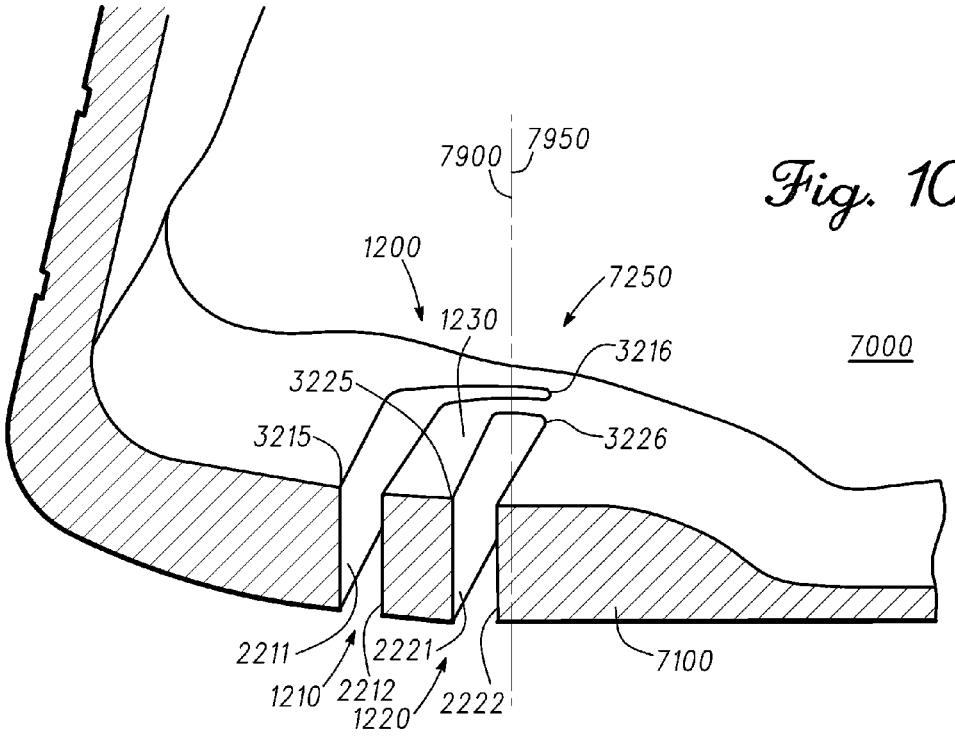
FIG. 10 illustrates a detailed side cross-sectional view of the slit feature of the golf club head of FIG. 7.

FIG. 7 illustrates a front-bottom perspective view of golf club head 7000 having slit feature 1200 at sole 7100 thereof. FIG. 8 illustrates a bottom view of golf club head 7000. FIG. 9 illustrates a side cross-sectional view of golf club head 7000. FIG. 10 illustrates a detailed side cross-sectional view of slit feature 1200 at sole 7100 of golf club head 1000.

Golf club head 7000 is similar to golf club head 7000, but comprises a hybrid-type golf club head in the present embodiment. Slit feature 1200 is located at sole 7100, but can be located elsewhere in other embodiments, such as at crown 9500 (FIG. 9) or at the skirt of golf club head 7000. The slits of slit feature 1200 can have a gasket, similar to the gasket described in the previous embodiment of FIGS. 1-6.

In the present example, golf club head 7000 comprises shaft axis 7900 and shaft axis plane 7950, which can be respectively similar to shaft axis 2900 and shaft axis plane 2950 (FIGS. 2-6). Slit feature 1200 is located such that it is only partially forward of shaft axis plane 7950. For instance, front forwardmost point 3215 of front slit 1210 and back forwardmost point 3225 of back slit 1220 are located forward of shaft axis plane 7950, but front rearwardmost point 3216 of front slit 1210 and back rearwardmost point 3226 of back slit 1220 are located rearward of shaft axis plane 7950.

Figure 11:
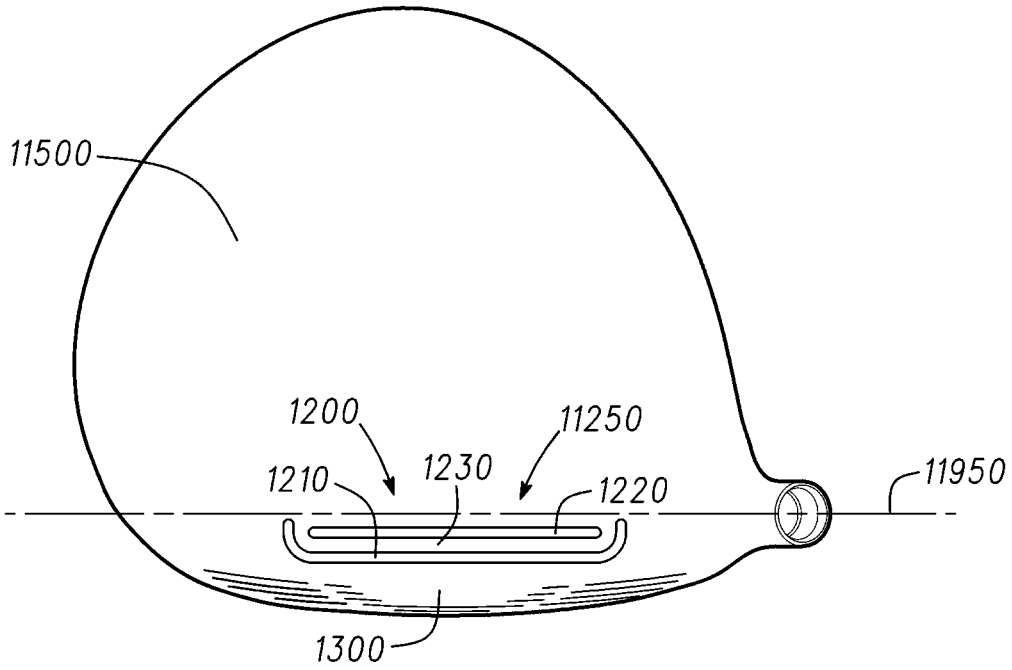
FIG. 11 illustrates a top view golf another golf club head having a slit feature at a crown thereof.

Although FIGS. 1-10 illustrate slit feature 1200 at the soles of their respective golf club heads, there can be embodiments where a golf club head can have a slit feature like slit feature 1200 at its crown, and/or at both its crown and its sole. For instance, FIG. 11 illustrates a top view golf club head 11000 having slit feature 1200 at crown 11500 thereof. There can also be examples where a golf club head can have a slit feature like slit feature 1200 at its skirt or extending to its skirt from its crown or its sole.

Figure 12:
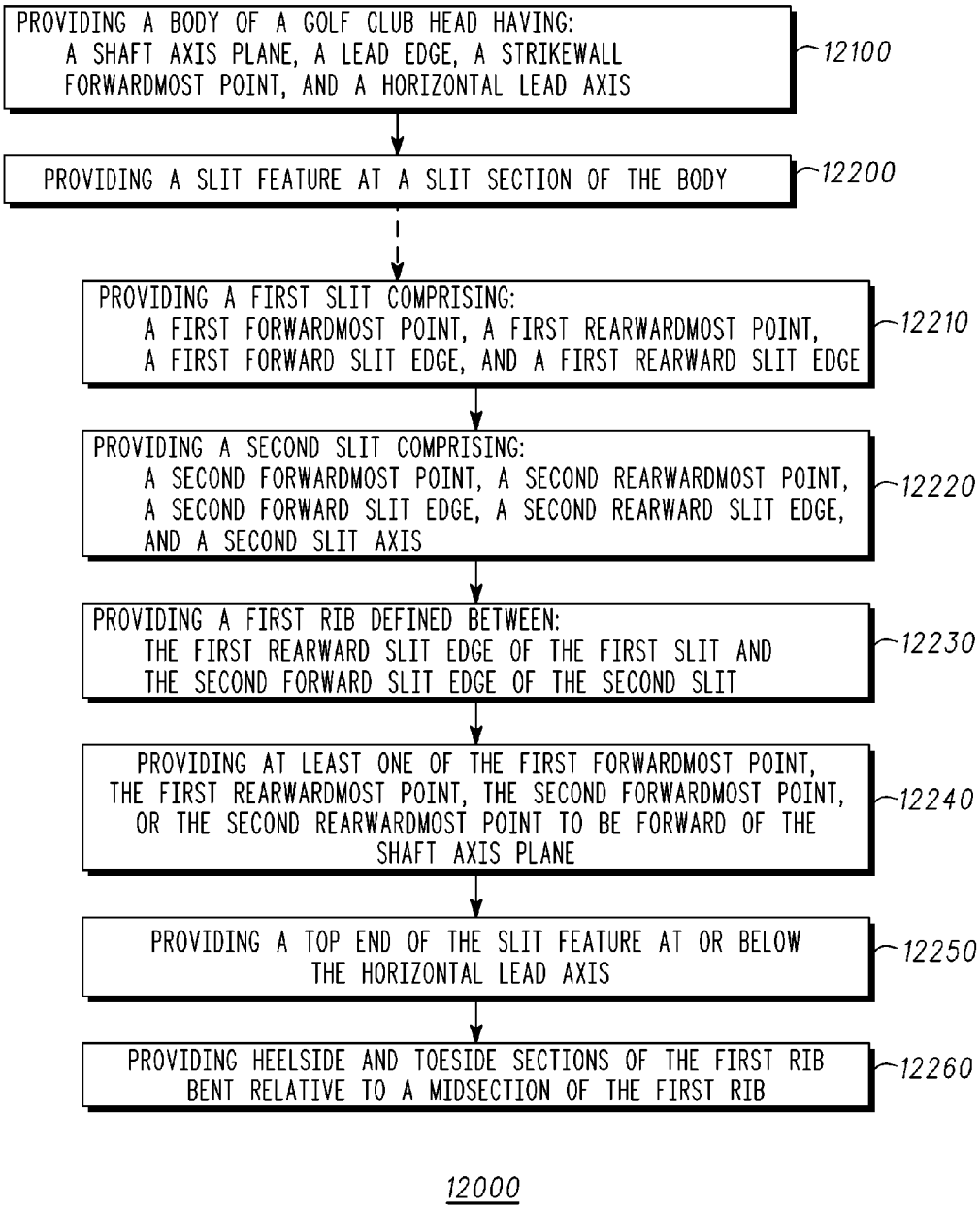
FIG. 12 illustrates a flowchart of a method for providing a golf club head that can be similar to one or more of the golf club heads described herein.

FIG. 12 illustrates a flowchart of a method 12000 for providing a golf club head. In some examples, the golf club head can be similar to one or more of the golf club heads previously described, such as golf club head 1000 (FIGS. 1-6), golf club head 7000 (FIGS. 7-10), golf club head 11000 (FIG. 11), and/or variations thereof.

Block 12100 of method 12000 comprises providing a body of a golf club head having a shaft axis plane, a lead edge, a strikewall forwardmost point, and a horizontal lead axis. In some examples, the body can be similar to body 1001 of golf club head 1000 (FIGS. 1-6), to the body of golf club head 7000 (FIGS. 7-10), and/or to the body of golf club head 11000 (FIG. 11).

In the same or other examples, the shaft axis plane can be similar to shaft axis plane 2950 (FIGS. 2-6), shaft axis plane 7950 (FIGS. 7-10), or shaft axis plane 11950 (FIG. 11). The lead edge can be similar to lead edge 2350 (FIGS. 2-6), to the lead edge of golf club head 7000 (FIGS. 7-10), and/or to the lead edge of golf club head 11000 (FIG. 11). The strikewall forwardmost point can be similar to strikewall forwardmost point 2351 (FIGS. 2-6), and/or to the strikewall forwardmost point of golf club head 7000 (FIGS. 7-10) or of golf club head 11000 (FIG. 11). The horizontal lead axis can be similar to horizontal lead axis 6910 (FIGS. 5-6) and/or to the horizontal lead axis of golf club head 7000 (FIGS. 7-10) or of golf club head 11000 (FIG. 11).

Block 12200 of method 12000 comprises providing a slit feature at a slit section of the body. In some examples, the slit feature can be similar to slit feature 1200 (FIGS. 1-11). In the same or other examples, the slit section can comprise at least a portion of a crown, a sole, and/or a skirt of the golf club head, and/or be similar to slit section 1250 (FIGS. 1-6), slit section 7250 (FIGS. 7-10), and/or slit section 11250 (FIG. 11).

Block 12200 can comprise several sub-blocks. For example, sub-block 12210 involves providing a first slit comprising a first forwardmost point, a first rearwardmost point, a first forward slit edge, and a first rearward slit edge. In some examples, the first slit can be similar to front slit 1210 (FIGS. 1-11). Similarly, the first forwardmost point can be similar to front forwardmost point 3215 (FIGS. 3, 6), the first rearwardmost point can be similar to front rearwardmost point 3216 (FIGS. 3, 6), the first forward slit edge can be similar to front forward slit edge 2211 (FIGS. 2, 6), and the first rearward slit edge can be similar to front rearward slit edge 2212 (FIGS. 2, 6).

Sub-block 12220 involves providing a second slit comprising a second forwardmost point, a second rearwardmost point, a second forward slit edge, a second rearward slit edge, and a second slit axis. In some examples, the second slit can be similar to back slit 1220 (FIGS. 1-11). Similarly, the second forwardmost point can be similar to back forwardmost point 3225 (FIG. 3, 6), the second rearwardmost point can be similar to back rearwardmost point 3226 (FIGS. 3, 6), the second forward slit edge can be similar to back forward slit edge 2221 (FIGS. 2, 6), the second rearward slit edge can be similar to back rearward slit edge 2222 (FIGS. 2, 6), and the second slit axis can be similar to back slit axis 2224.

Sub-block 12230 involves providing a first rib defined between the first rearward slit edge of the first slit and the second forward slit edge of the second slit. In some examples, the first rib can be similar to rib 1230 (FIGS. 1-11). In some implementations, the first slit, the second slit, and/or the first rib can be formed via a casting process and/or a machining process.

Sub-block 12240 can involve providing at least one of the first forwardmost point, the first rearwardmost point, the second forwardmost point, or the second rearwardmost point to be forward of the shaft axis plane. For instance, one embodiment can be similar to that illustrated in FIG. 6 with respect to shaft axis plane 2950. As another example, an embodiment can be similar to that illustrated in FIG. 10 with respect to shaft axis plane 7950. Other variations where one or more different ones of the first forwardmost point, the first rearwardmost point, the second forwardmost point, or the second rearwardmost are forward of the shaft axis plane are also envisioned. In some implementations, however, sub-block 12240 can be optional.

Sub-block 12250 can involve providing a top end of the slit feature at or below the horizontal lead axis. For instance, one embodiment can be similar to that illustrated in FIG. 6 with respect to top end 6741 of slit feature 1200 being below horizontal lead axis 6920 and/or horizontal lead plane 5930. In some implementations, however, sub-block 12250 can be optional.

Sub-block 12260 can involve providing heelside and toeside sections of the first rib bent relative to a midsection of the first rib. In some examples the heelside section, the toeside section, and the midsection of the first rib can be respectively similar to front slit heelside section 2217, front slit toeside section 2216, and front slit midsection 2215 (FIG. 2), bent or curved as shown or described with respect to the examples of FIGS. 1-11.

There can be examples where different blocks of method 12000 can be combined into a single block or performed simultaneously, and/or where the sequence of such blocks can be changed. For instance, blocks 12100 and 12200 can be carried out simultaneously, such as where the slit feature is formed integral and/or at the same time with the body of the golf club head. There can also be examples where method 12000 can comprise further or different blocks. As an example, method 12000 can comprise another block for coupling a golf club shaft to a hosel of the golf club head, and/or another block for providing a gasket material similar to gasket material 3206 (FIG. 3) in at least one of the first or second slits. Other variations can be implemented for method 12000 without departing from the scope of the present disclosure.

Although the golf club heads with slit features and related methods herein have been described with reference to specific embodiments, various changes may be made without departing from the spirit or scope of the present disclosure. As an example, one embodiment can comprise a slit feature similar to slit feature 1200, but with more than two slits and/or with more than one rib.

Additional examples have been given in the foregoing description. Other permutations of the different embodiments having one or more of the features of the various figures are likewise contemplated. Accordingly, the disclosure herein is intended to be illustrative and is not intended to be limiting. It is intended that the scope of this application shall be limited only to the extent required by the appended claims.

The golf club heads with slit features and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a fairway wood-type golf club and a hybrid-type golf club, the apparatus, methods, and articles of manufacture described herein may be applicable to other types of golf club such as a driver-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a body comprising a sole, a crown, a hosel, a body heel end, a body toe end, a body rear portion, and a strikewall; and a slit feature at a slit section of the body;

wherein:

the slit section comprises a portion of one of the sole or the crown;

the hosel defines a shaft axis and a shaft axis plane that comprises the shaft axis and is orthogonal to a ground plane when the golf club head is at address over the ground plane;

a lead edge comprising a strikewall forwardmost point of the strikewall; and a horizontal lead axis, comprising the strikewall forwardmost point, and orthogonal to the shaft axis plane;

wherein:

the horizontal lead axis does not intersect the slit feature; and the slit feature comprises:

a first slit comprising:

a first slit height;

a first slit width;

a first forward slit edge;

a first rearward slit edge;

a first slit midsection;

a first toeside rewardmost point; and a first heelside rearwardmost point;

wherein the first slit is curved from the first slit midsection extending to the first toeside rewardmost point and to the first heelside rewardmost point, the curve allowing the first slit to be narrowed while still allowing the first slit to withstand or dissipate impact stresses without compromising the structural integrity of the golf club head;

a second slit comprising:

a second slit height;

a second slit width;

a second forward slit edge; and a second rearward slit edge;

a first rib defined between:

the first rearward slit edge of the first slit;

the second forward slit edge of the second slit; and wherein:

at least one of the first slit height or second slit height increases toward a center of the slit feature.

2. The golf club head of claim 1, wherein:

at least one of the following is located forward of the shaft axis plane:

a first slit forwardmost point of the first slit;

a first slit rearwardmost point of the first slit;

a second slit forwardmost point of the second slit; or a second slit rearwardmost point of the second slit.

3. The golf club head of claim 1, wherein:

the slit feature is at least partially filled with a gasket material with a low modulus of elasticity and rigidity.

4. The golf club head of claim 3, wherein:

the gasket material is one of a urethane material, a caulk material, or a silicon material.

5. The golf club head of claim 1, further comprising:

a vertical lead plane tangent to the lead edge and parallel to the shaft axis plane; and a slit feature offset comprising a minimum distance from the vertical lead plane to the first forward slit edge;

wherein:

the first slit is between the strikewall and the second slit; and the slit feature offset is approximately 2.5 mm to approximately 15.2 mm.

6. The golf club head of claim 1, wherein:

the first slit comprises:

a first slit toewardmost point closest to the body toe end;

a first slit heelwardmost point closest to the body heel end; and a first slit length, measured from the first slit toewardmost point to the first slit heelwardmost point, of approximately 25.4 mm to approximately 76.2 mm.

7. The golf club head of claim 6, wherein:

the second slit comprises:

a second slit toewardmost point closest to the body toe end;

a second slit heelwardmost point closest to the body heel end; and a second slit length, measured from the second slit toewardmost point to the second slit heelwardmost point;

and the second slit length is approximately 75% to approximately 90% of the first slit length.

8. The golf club head of claim 1, wherein:

the slit feature comprises:

a slit section interior surface facing an interior of the body;

a slit section exterior surface facing an exterior of the body; and a slit height of approximately 0.8 mm to approximately 12.7 mm, measured at the first forward slit edge, from the slit section interior surface to the slit section exterior surface.

9. A golf club head comprising:

a body comprising a sole, a crown, a hosel, a body heel end, a body toe end, a body rear portion, and a strikewall; and a slit feature at a slit section of the body;

wherein:

the slit section comprises a portion of one of the sole or the crown;

the hosel defines a shaft axis and a shaft axis plane that comprises the shaft axis and is orthogonal to a ground plane when the golf club head is at address over the ground plane;

a lead edge comprising a strikewall forwardmost point of the strikewall; and a horizontal lead axis, comprising the strikewall forwardmost point, and orthogonal to the shaft axis plane;

wherein:

the horizontal lead axis does not intersect the slit feature; and the slit feature comprises:
a first slit comprising:
a first slit height;
a first slit width;
a first forward slit edge;
a first rearward slit edge;
a first slit midsection;
a first toeside rewardmost point; and
a first heelside rearwardmost point;
wherein the first slit is curved from the first slit midsection extending to the first toeside rewardmost point and to the first heelside rewardmost point, the curve allowing the first slit to be narrowed while still allowing the first slit to withstand or dissipate impact stresses without compromising the structural integrity of the golf club head;
a second slit comprising:
a second slit height;
a second slit width;
a second forward slit edge; and
a second rearward slit edge;
a first rib defined between:
the first rearward slit edge of the first slit;
the second forward slit edge of the second slit; and
wherein:
at least one of the first slit height or second slit height decreases toward a center of the slit feature.

10. The golf club of claim 9, wherein:
at least one of the following is located forward of the shaft axis plane:
a first slit forwardmost point of the first slit;
a first slit rearwardmost point of the first slit;
a second slit forwardmost point of the second slit; or
a second slit rearwardmost point of the second slit.

11. The golf club head of claim 10, wherein:
the first slit rearwardmost point is located forward of the shaft axis plane.

12. The golf club head of claim 10, wherein:
the second slit forwardmost point is located forward of the shaft axis plane.

13. The golf club head of claim 10, wherein:
the second slit rearwardmost point is located forward of the shaft axis plane.

14. The golf club head of claim 9, further comprising:
a vertical lead plane tangent to the lead edge and parallel to the shaft axis plane; and
a slit feature offset comprising a minimum distance from the vertical lead plane to the first forward slit edge;
wherein:
the first slit is between the strikewall and the second slit; and
the slit feature offset is approximately 2.5 mm to approximately 15.2 mm.

15. The golf club head of claim 9, wherein:
the first slit comprises:
a first slit toewardmost point closest to the body toe end;
a first slit heelwardmost point closest to the body heel end; and
a first slit length, measured from the first slit toewardmost point to the first slit heelwardmost point, of approximately 25.4 mm to approximately 76.2 mm.

16. The golf club head of claim 15, wherein:
the second slit comprises:
a second slit toewardmost point closest to the body toe end;
a second slit heelwardmost point closest to the body heel end; and
a second slit length, measured from the second slit toewardmost point to the second slit heelwardmost point;
and
the second slit length is approximately 75% to approximately 90% of the first slit length.

17. The golf club head of claim 9, wherein:
the slit feature comprises:
a slit section interior surface facing an interior of the body;
a slit section exterior surface facing an exterior of the body; and
a slit height of approximately 0.8 mm to approximately 12.7 mm, measured at the first forward slit edge, from the slit section interior surface to the slit section exterior surface.

18. The golf club head of claim 9, wherein:
the first slit comprises:
a first slit heelside section; and
a first slit toeside section;
the second slit comprises:
a second slit toewardmost point closest to the body toe end;
a second slit heelwardmost point closest to the body heel end; and
a second slit axis through the second slit heelwardmost point and the second slit toewardmost point; and
the second slit axis intersects the first slit heelside section and the first slit toeside section.

19. A method for providing a golf club head, the method comprising:
providing a body comprising a sole, a crown, a hosel, a body heel end, a body toe end, a body rear portion, and a strikewall; and
providing a slit feature at a slit section of the body;
wherein:
the slit section comprises a portion of one of the sole or the crown;
the hosel defines a shaft axis and a shaft axis plane that comprises the shaft axis and is orthogonal to a ground plane when the golf club head is at address over the ground plane;
providing a lead edge comprising a strikewall forwardmost point of the strikewall; and
a horizontal lead axis, comprising the strikewall forwardmost point, and orthogonal to the shaft axis plane;
wherein:
the horizontal lead axis does not intersect the slit feature; and
the slit feature comprises:
a first slit comprising:
a first slit height;
a first slit width;
a first forward slit edge;
a first rearward slit edge;
a first slit midsection;
a first toeside rewardmost point; and
a first heelside rearwardmost point;
wherein the first slit is curved from the first slit midsection extending to the first toeside rewardmost point and to the first heelside rewardmost point, the curve allowing the first slit to be narrowed while still allowing the first slit to withstand or dissipate impact stresses without compromising the structural integrity of the golf club head;

a second slit comprising:

a second slit height;

a second slit width;

a second forward slit edge; and a second rearward slit edge;

a first rib defined between:

the first rearward slit edge of the first slit;

the second forward slit edge of the second slit; and wherein:

at least one of the first slit height or second slit height, increases toward a center of the slit feature.

20. The golf club head of claim 16, further comprising:

a vertical lead plane tangent to the lead edge and parallel to the shaft axis plane; and a slit feature offset comprising a minimum distance from the vertical lead plane to the first forward slit edge;

wherein:

the first slit is between the strikewall and the second slit; and the slit feature offset is approximately 2.5 mm to approximately 15.2 mm.

* * * * *